US006224539B1

(12) United States Patent
Jones et al.

(10) Patent No.: US 6,224,539 B1
(45) **Date of Patent: *May 1, 2001**

(54) HEATER DOOR MECHANISM FOR INFANT WARMING APPARATUS

(75) Inventors: Thomas C. Jones, Columbia; Michael H. Mackin, Ellicott City, both of MD (US)

(73) Assignee: Datex-Ohmeda, Inc., Tewksbury, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/316,356

(22) Filed: May 21, 1999

(51) Int. Cl.[7] ..... A61G 11/00
(52) U.S. Cl. ..... 600/22
(58) Field of Search ..... 600/21–22; 119/308, 119/309, 311, 318, 319

(56) References Cited

U.S. PATENT DOCUMENTS

| | | | | |
|---|---|---|---|---|
| 4,936,824 | | 6/1990 | Koch et al. . | |
| 5,453,077 | | 9/1995 | Donnelly et al. . | |
| 5,474,517 | | 12/1995 | Falk et al. . | |
| 5,649,896 | * | 7/1997 | Barsky | 600/22 |
| 5,817,003 | * | 10/1998 | Moll et al. | 600/22 |
| 5,980,449 | * | 11/1999 | Benson et al. | 600/22 |
| 6,063,020 | * | 5/2000 | Jones et al. | 600/22 |

* cited by examiner

*Primary Examiner*—Samuel G. Gilbert
(74) *Attorney, Agent, or Firm*—Roger M. Rathbun

(57) ABSTRACT

An infant warming apparatus that functions both as an infant incubator as well as an infant warmer. The apparatus has a heater that moves vertically with respect to an infant support during the change in function between an infant incubator and infant warmer. A powered motive system, such as an electric motor, powers the movement of the heater between its upper and its lower positions. The heater also has a door or doors that are open when the heater is at or nearing the upper position so that the heater can direct energy toward the infant to warm the infant when acting as an infant warmer. The doors close at or shortly after the heater commences movement to the lower position. When closed, the doors isolate the heater to prevent the inadvertent touching of the heater by the infant or attending personnel and prevents the further radiating of infrared energy towards the infant. The mechanism operates automatically without any reminder to the user or action by the user. A vent is also provided in the heater housing that ventilates the housing when the heater is in its upper position and closes to confine the housing when the heater is in its lower position. A mechanism automatically closes the vent when the heater moves from its upper position to its lower position and opens the vent when the heater moves from its lower position to its upper position.

26 Claims, 7 Drawing Sheets

HEATER DOOR MECHANISM FOR INFANT WARMING APPARATUS

BACKGROUND

The present invention relates to an infant warming apparatus and, more particularly, to an apparatus for providing the combined functions of an infant incubator and an infant warmer and which includes a radiant heater contained within a housing having a doors that are operable to automatically open and close in accordance with a mechanism.

There are, of course, many devices or apparatus for the warming of an infant and to supply the necessary heat to maintain the infant at a predetermined temperature. Of the various apparatus, there are infant warmers that are basically planar surfaces on which the infant is positioned and which planar surfaces generally include side guards to keep the infant safely within the confines of the apparatus. Infant warmers normally have an overhead radiant heater that is located above the infant and which thus radiates energy in the infrared spectrum to impinge upon the infant to maintain the infant at a warm, predetermined temperature. Since the infant is otherwise totally exposed to the surroundings, there is almost unlimited access to the infant by the attending personnel to perform various procedures on that infant. At typical infant warmer is shown and described in U.S. Pat. No. 5,474,517 of Falk et al as prior art to that patent.

There are also infant incubators and which are more confined enclosures that contain the infant within an enclosed controlled atmosphere in an infant compartment that provides heat to the infant and also may provide control of humidity in the enclosed environment. Such incubators maintain the infant for long periods of time and include handholes to access the infant and/or there is normally a larger access door that can be opened to access the infant or to insert or remove the infant to and from the incubator. Such devices provide a good atmosphere to the infant and control that local environment within which the infant is located, however, it is sometime difficult to perform a wide variety of procedures on the infant due to the somewhat limited access to that infant. A typical infant incubator is shown and described in U.S. Pat. No. 4,936,824 of Koch et al.

At the present, there are also certain infant care apparatus that combine the functions of an infant warmer and an incubator. One such apparatus is shown and described in U.S. Pat. No. 5,453,077 of Donnelly et al and which has an overhead canopy including an infrared heater and the canopy and heater are raisable and lowerable with respect to an infant positioned in the apparatus. Therefore, the device can operate as an incubator when the canopy and heater are in the lowered position and can act as an infant warmer when the canopy and the heater are in the upper position.

One difficulty, however, is in the raising and lowering of the heater. It is important to insure that the infant as well as the attending personnel are not subjected to the possibility of touching any of the heated surfaces of the heater or components that are warmed by contact or close proximity to that heater. In addition, it is also important that radiant energy from the various heated surfaces connected with the heater, as well as convective heat not continue to be emitted from those surfaces when the heater is in close proximity to the infant. As such, therefore it is advantageous that the heater be lowered fairly rapidly when the user decides to convert the operation from that of an infant warmer to that of an infant incubator and where the heater is lowered to the incubator position in close proximity to the infant. The heater itself takes a certain period of time to cool down and normal lowering of the heater does not afford sufficient time for that cool-down to take place.

Accordingly, when the heater is lowered, there are still surfaces of the heater and its housing that are hot spots and which continue to radiate heat that is focused in the direction of the infant only at that point, the heater is located at a close proximity to the infant. Thus those hot spots can cause localized heated areas of the infant and the effect potentially harmful to the infant. It is therefore, important that some means be provided to prevent those surfaces from radiating to the infant or from being inadvertent touched by the infant or any of the attending personnel.

As a further difficulty, there may be other openings in the housing containing the radiant heater that suffer from the same infirmity, that is, when the radiant heater canopy is lowered to a position in close proximity to the personnel using the infant warming apparatus, there is a possibility of inadvertent touching of the warmed components of the radiant heater and its surrounding surfaces. Such additional openings may be vent openings that are generally needed to prevent overheating of the radiant heater and are, thus, of necessity, require to be open when the heater canopy is in it upper position and the radiant heater is energized but can pose a hazard if left open when in the lower position accessible by personnel.

SUMMARY OF THE INVENTION

Accordingly, the present invention relates to an infant care apparatus that combines the functions of an infant care warmer and an incubator but in addition, has a door or doors that can close when the canopy including the radiant heater is lowered toward the infant and open when the canopy and heater are again raised to the upper position.

Thus, the heater itself as well as the surrounding housing adjacent surfaces that are heated by the conduction from the radiant heater are concealed from the user and the infant when in its lower position and the doors thus block further radiant heat and convective heat from reaching the infant. By use of the present invention, that closed status is automatically achieved by the mechanism as the heater canopy progresses from its upper position to its lower position and the door or doors are safely closed without some reminder or action on the part of a user. In reverse, as the heater is raised when the user desires the apparatus to be used as a radiant infant warmer, the door or doors automatically open so that the heater can be energized to direct radiant infrared energy to impinge upon the infant. Again, the operation of the mechanism is automatic and needs no action on the part of a user other than to indicate to the infant warming apparatus what warmer position is desired at the time.

In the preferred embodiment, there are two doors that open and close to contain the heater as with only one door, it is possible in a failure mode, that if the door does not close upon reaching its lower position, the door has sufficient width that it may actually touch the infant. With two doors, each door is reduced in width such that the danger of the door touching the infant in the lower position is eliminated.

As a further refinement, a mechanism is provided that is a mechanical system that opens and closes the doors as the heater moves, respectively, to the upper position and to the lower position.

It is preferred, that the actual opening and closing take place at or near the upper position. It is preferable that the mechanism operate such that the doors open and close at a point within no more than about 12 inches from the upper position, and more preferably 6–8 inches. In that manner, there is some assurance that the door does not open as the heater canopy is moving upwards until the heater canopy has reached almost to its upper position so that the doors do not open to present a hazard at a low position where the heater could still be within the reach of the infant or other persons. More importantly, the heater doors close immediately upon being lowered, again within 6–8 inches and thus insures that the doors are fully closed before the heater can reach any lower height where it could be reached by the infant and the attending personnel.

As a further feature of the operation of the invention, there is a vent opening in the heater housing that allows the natural convective circulation of air to when the radiant heater is activated. In such manner, the convective cooling prevents the heater from overheating within the heater housing. While that is an important function, to allow the cooling, when the radiant heater is activated, the presence of vent opening it the open position can also be a hazard without some protection when the heater canopy is in its lower position.

Accordingly, in accordance with the present invention, a vent flap is provided that opens and closes the vent opening so that the vent flap, at the lower position of the heater canopy, effectively closes the vent opening so that the internal components of the heater housing cannot be reached by persons in proximity to the infant warming apparatus. Again, the opening and closing of the vent flap is automatic and operates without any action on the part of the user. As the heater canopy is lowered, the vent flap automatically closes in a positive manner and, conversely, as the heater canopy is raised, the vent flap opens so that the natural convective flow of cooling air is available wherever the radiant heater is activated.

Thus, as safety features, both the vent flap is biased toward its open, or safest position, while the doors protecting the heater are biased toward their closed position, again, the safest position of the doors in the even of a failure of any one or more of the actuating mechanisms.

These and other features and advantages of the present invention will become more readily apparent during the following detailed description taken in conjunction with the drawings herein.

DETAILED DESCRIPTION OF THE INVENTION

Figure 1:
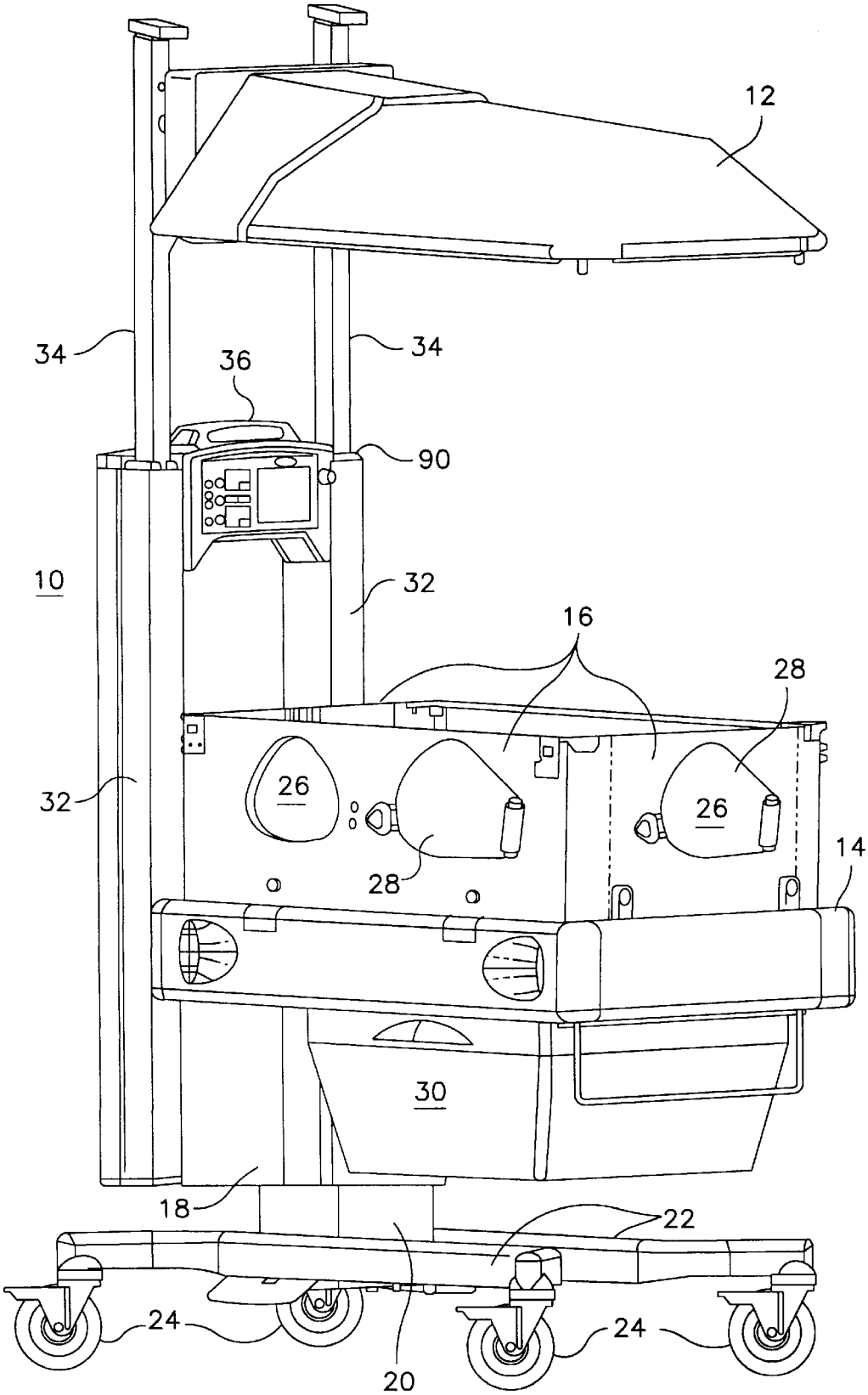
FIG. 1 of a perspective view of the infant warming apparatus constructed in accordance with the present invention wherein the radiant heater is shown in its upper position.
Figure 2:
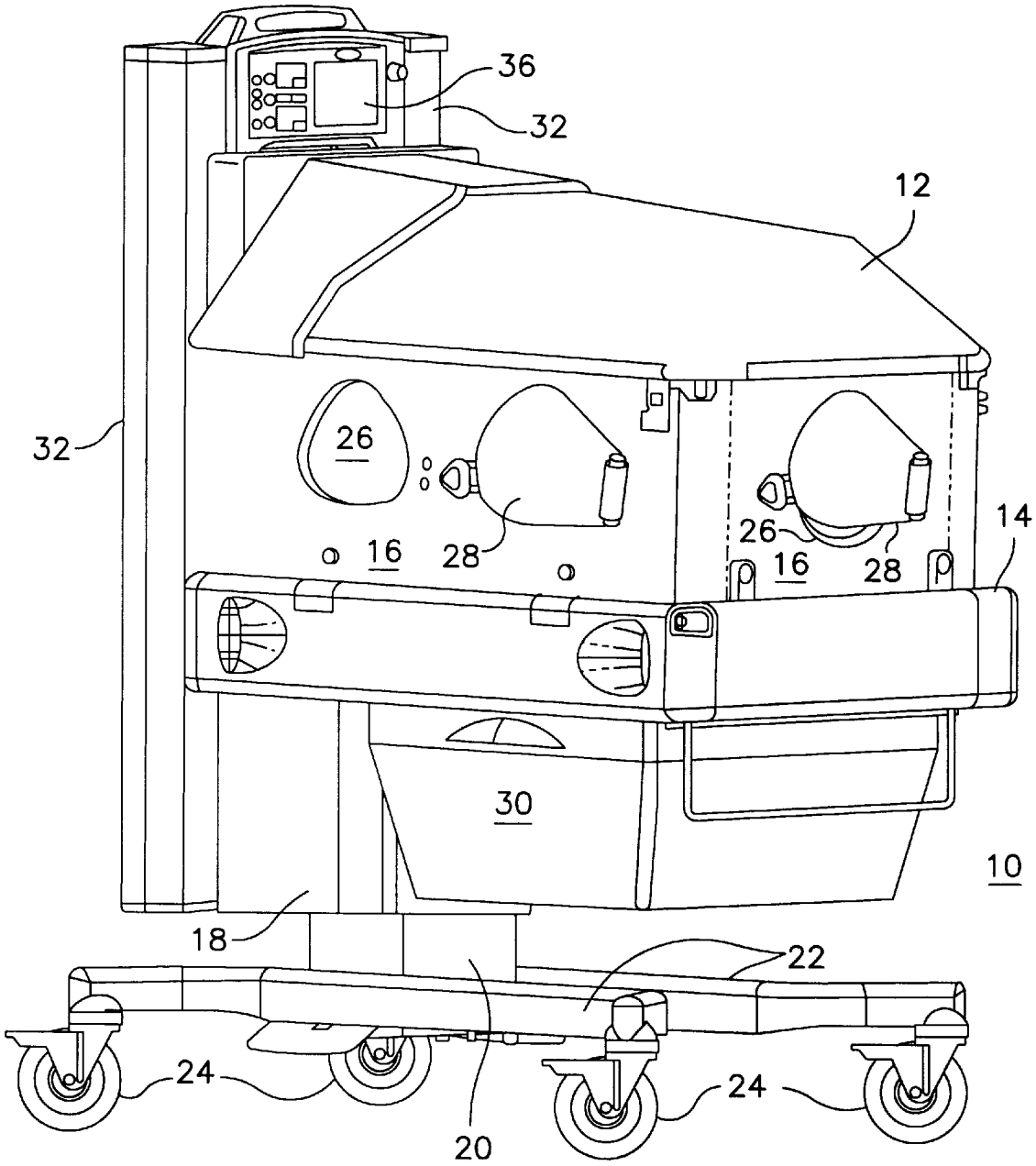
FIG. 2 is a schematic view of the apparatus of FIG. 1 but showing the radiant heater in its lower position.

Referring now to FIG. 1, there is shown a perspective view of an infant warming apparatus 10 constructed in accordance with the present invention with the heater canopy 12 in its upper position. Referring also to FIG. 2, there is a perspective view of the infant warming apparatus 10 as shown in FIG. 1 but with the heater canopy 12 in its lower position. As will be understood, in the FIG. 1 position, the infant warming apparatus 10 acts as an infant warmer with considerable access to the infant for performing interventions on the infant and in the FIG. 2 configuration, the infant warming apparatus 10 acts as an incubator with the infant confined within a protective environment and having a controlled atmosphere to provide warmth as well as controlled humidity.

As shown, the infant warming apparatus 10 includes an infant pedestal 14 that underlies and supports an infant. As is also seen, a plurality of walls 16 are provided to contain the infant safely within the infant warming apparatus 10 and are located at all of the four sides of the infant pedestal 14. The walls 16 are preferable constructed of transparent plastic material and, as will be explained, cooperate with other components in order to provide an incubator function to the infant warming apparatus 10 when in the FIG. 2 configuration.

The infant pedestal 14 is mounted to a vertical movable base member 18 which, in the preferred embodiment, is movably affixed to a stationary vertical base member 20, which, in turn, is mounted to a base 22 having wheels 24 for ready movement of the infant warming apparatus 10.

The vertical movable base member 18 is preferably mounted so that the user can adjust the height of the infant pedestal 14 by raising and lowering the movable vertical member 18 as desired, thus the infant pedestal 14 can be adjusted to the preferred height by the user. As further standard features, the walls 16 have handholes 26 to afford access to the infant when in the incubator configuration of FIG. 2, and which generally have doors 28 that can be opened to obtain access to the infant and, of course, closed when the particular intervention has been completed to preserve the desired environment within the incubator configuration.

Another convenient feature includes a drawer 30 to retain supplies or other devices needed to carry out some operation on the infant and which is normally located beneath the infant pedestal 14. Other features include the maneuverability of the walls 16 that are pivotally mounted at their bases to the infant pedestal 14 such that the doors can be swung outwardly and downwardly and, as a further alternative, can be easily fully removed from the infant pedestal 14. As such, therefore, when the heater canopy 12 of the infant warming apparatus 10 is in its upper position as shown in FIG. 1, the walls 16 can be dropped downwardly or removed altogether so that the attending personnel can have unlimited access to an infant resting on the infant pedestal 14 to perform interventions on that infant.

Further structural components of the infant warming apparatus 10 include stationary frame members 32 that are affixed to the vertical movable base member 20 and, as shown, there are two vertical stationary frame members 32 in the preferred embodiment although there may be only one or there may be further numbers of such members. Two movable frame members 34 are movably fitted into the stationary frame members 32 and which can be moved upwardly and downwardly by the user as will be explained.

A control module 36 is conveniently positioned intermediate the stationary frame members 32 and may include displays of various monitored parameters as well as include the various controls for operation of the functions of the infant warming apparatus 10.

As may now be seen in general, in the operation of the infant warming apparatus 10, the heater canopy 12 houses a radiant heater (not shown in FIGS. 1 and 2) and as will be later explained. The heater canopy 12 can be moved between its lower position as shown in FIG. 2 and its upper position as shown in FIG. 1 depending upon the mode of operation desired by the user. In the upper position of FIG. 1, the infant care apparatus 10 functions as an infant warmer where there is full access to the infant and where an overhead radiant warmer supplies heat to maintain the infant with sufficient warmth. In the lower position of FIG. 2, the infant warming apparatus 10 functions as a normal incubator, since the outer periphery of the infant canopy 12 fits fully over the upper edges of the walls 16 to form therein, an infant compartment that is provided with warm air and controlled humidity in the normal functioning of an incubator.

Figure 3A:
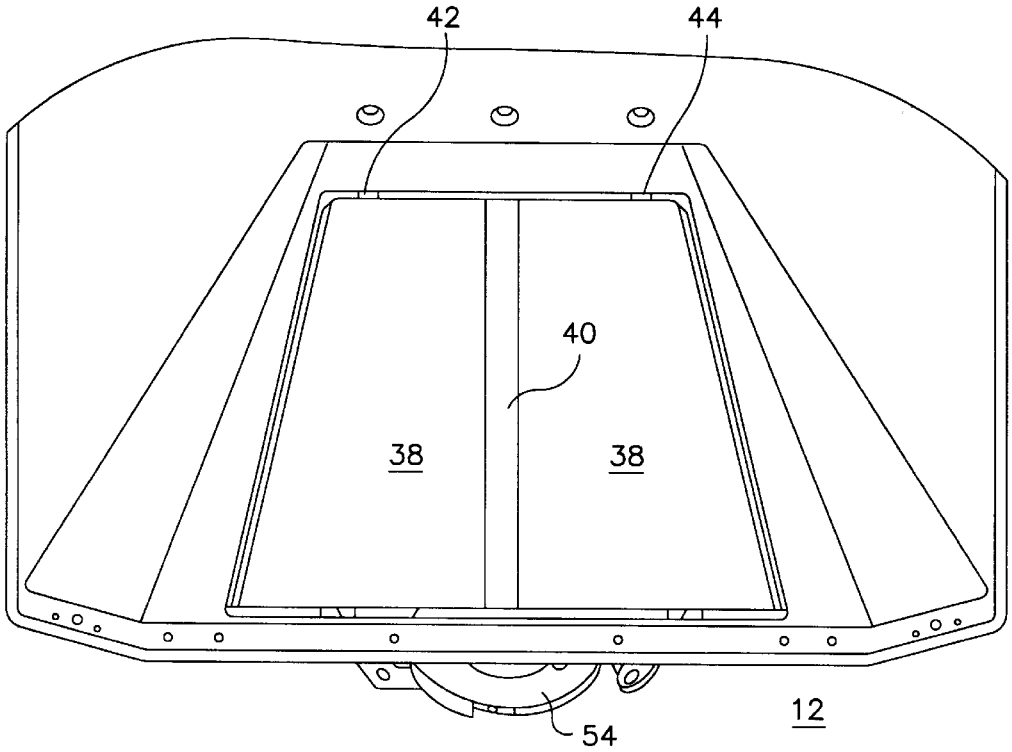
FIG. 3A is a bottom isometric view of the heater canopy used with the present invention with the heater doors in the closed position and FIG. 3B is an end isometric view showing the heater doors in the position of FIG. 3A.
Figure 3B:
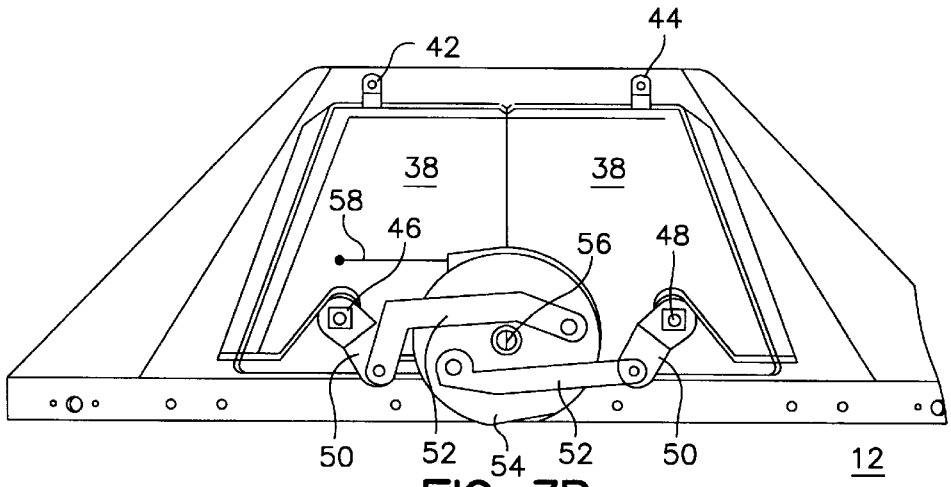

Turning now to FIGS. 3A and 3B, there is shown, respectively, a bottom isometric view of the heater canopy 12 and an end isometric view of the heater canopy 12 where the heater canopy 12 is in its lower position, that is, in the position as shown in FIG. 2. In FIG. 3A, as can be seen, there is a pair of doors 38 that are shown in the closed position and where the doors 38 overlap to a certain degree at overlap 40. As explained, in the preferred embodiment, two doors 38 are used in carrying out the present invention. However, there may be only one door or even more than two. There is a disadvantage with only one door in that the door needs to be considerably wide and can reach into the infant compartment when in the lowered position if a fault occurs and the door does not fully close during its descent to its lower position.

In this position, the radiant heater, not shown in FIG. 3A, is safely contained within the heater canopy 12 and is protected by the doors 38 from being touched by the infant within the infant warming apparatus 10 or for any further radiant or convective heat being directed toward the infant from heated surfaces within the heater canopy 12. Thus, the infant canopy 12 can, at this point, be safely in its lower position since any further heat is blocked by the doors 38 from reaching the infant and the radiant heater is protected from inadvertent touching by the infant or by any of the attending personnel.

Taking FIG. 3A along with the FIG. 3B, it can be seen that the doors 38 are pivotally mounted to the heater canopy 12 at pivot points 42 and 44 at one side of the doors and at pivot points 46 and 48 at the other side of the doors 38 so that the doors 38 can move between their open and closed positions. Each door has a door pivot arm 50 that is connected to and causes the movement of the doors 38, that is, as the door pivot arm 50 is rotated, the corresponding door 38 also pivots so that the door pivot arms 50 basically are rotated to move the doors 38 between their open and closed positions. Further connected to the door pivot arms 50 are a pair of door links 52 and which, in turn cause the door pivot arms 50 to rotate.

As can be seen, both of the door links 52 are pivotally connected to a cable spool 54 and which, itself, is rotatably affixed to the heater canopy 12 at the centerpoint 56 of the cable spool 54 such that the points of affixation of both of the door links 52 are at predetermined radii from that centerpoint 56. Thus, as the cable spool 54 rotates about its centerpoint 56, the door links 52 move and thereby cause the door pivot arms 50 to correspondingly move to pivot the doors 38 between open and closed positions. Thus, in summary, the cable spool 54 is rotatable to open and close the doors 38 by means of the linkages, i.e. door links 52 and door pivot arms 50. A cable 58 is partially wrapped about the outer periphery of the cable spool 54 and its use will be later explained, it being enough to note that the pulling of the cable 58 serves to rotate the cable spool 54 and thus operate the doors 38. The cable spool 54 is also spring biased toward its clockwise or closed door position by means of a spiral spring, not shown in FIGS. 3 and 3A.

Figure 4A:
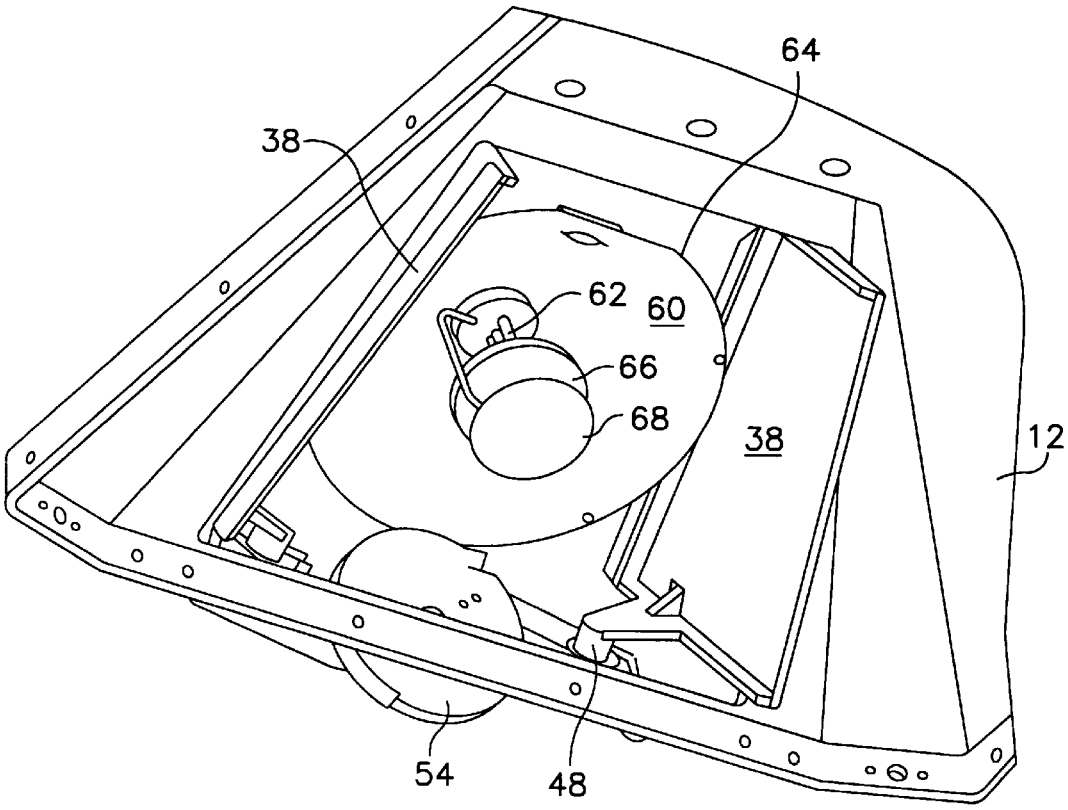
FIG. 4A is a bottom isometric view of the heater canopy used with the present invention with the heater doors in the open position and FIG. 4B is an end isometric view showing the heater doors in the position of FIG. 4A.
Figure 4B:
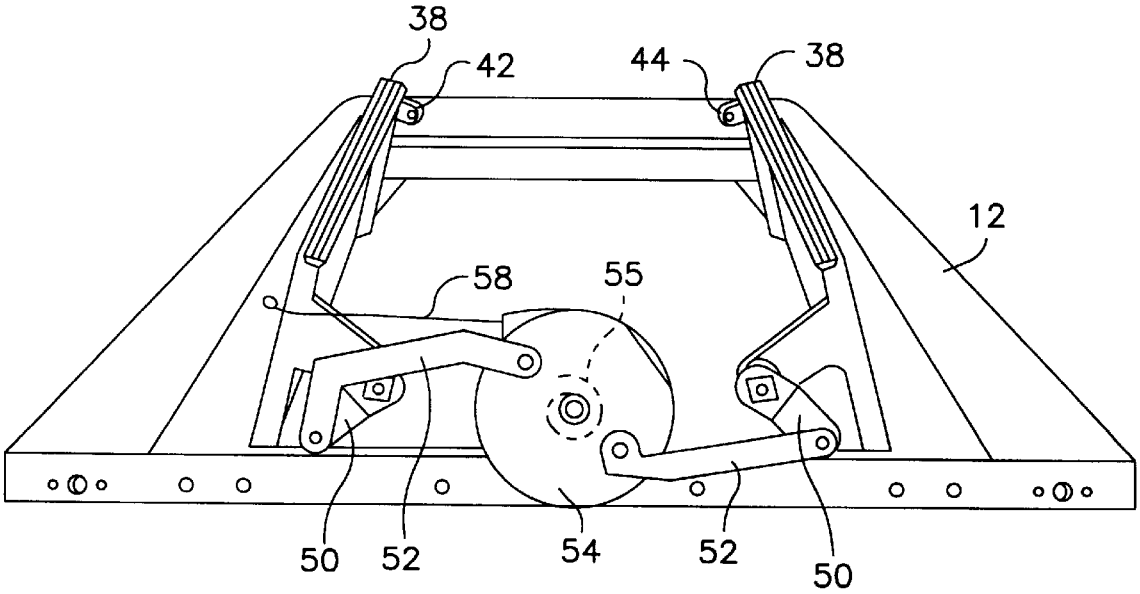

Turning now to FIGS. 4A and 4B, there is shown, respectively, a bottom isometric view of the heater canopy 12 and an end isometric view of the heater canopy 12 showing the doors 38 in their open position, that is, when the heater canopy 12 is in its upper position as shown in FIG. 1. As seen in this Figure, the cable spool 54 has been rotated from its position in FIGS. 3A and 3B, resulting in the doors 38 being rotated to their open position and which increases the tension on the spring 55 to cause the spring 55 to more tightly coil and create a bias in the clockwise direction of the cable spool 54 biasing the doors 38 toward their closed positions. As also can be seen, specifically, in FIG. 4A, a radiant heater 60 is present and which provides the radiant energy in the infrared spectrum to impinge upon an infant when positioned in the infant warming apparatus 10.

Various types of radiant heaters may be used, however, the preferred radiant heater is shown and described in a patent application entitled Radiant Heater For Infant Warmers and filed by the same assignee of the present application and on the same day as the present application, the disclosure of which is incorporated herein by reference. Briefly, however, the radiant heater 60 of the preferred embodiment, includes an infrared emitter 62 that provides the infrared radiation and which is reflected towards an infant by means of reflector 64. The reflector 64 is preferable of a particular geometric configuration such as an ellipsoid, a paraboloid or an hyperboloid. A deflector 66 is used to deflect some of the infrared energy otherwise directed toward an infant back toward and then re-reflected from the reflector 64. For added safety, a heat shield 68 is mounted on the downward side of the deflector 66 to prevent the high temperature of the deflector 66 from being accessible by the user.

Of note in the FIG. 4B illustration is that the cable 58 has pulled the doors 38 to the open position of that Figure by rotating the cable spool 54 in the counterclockwise direction against the bias exerted by spring 55. Accordingly, the bias of the spring 55 tends to move the doors toward their closed position and which is the safest position in the event of a failure of any of the mechanisms and the infant would be protected in such event.

Figure 5:
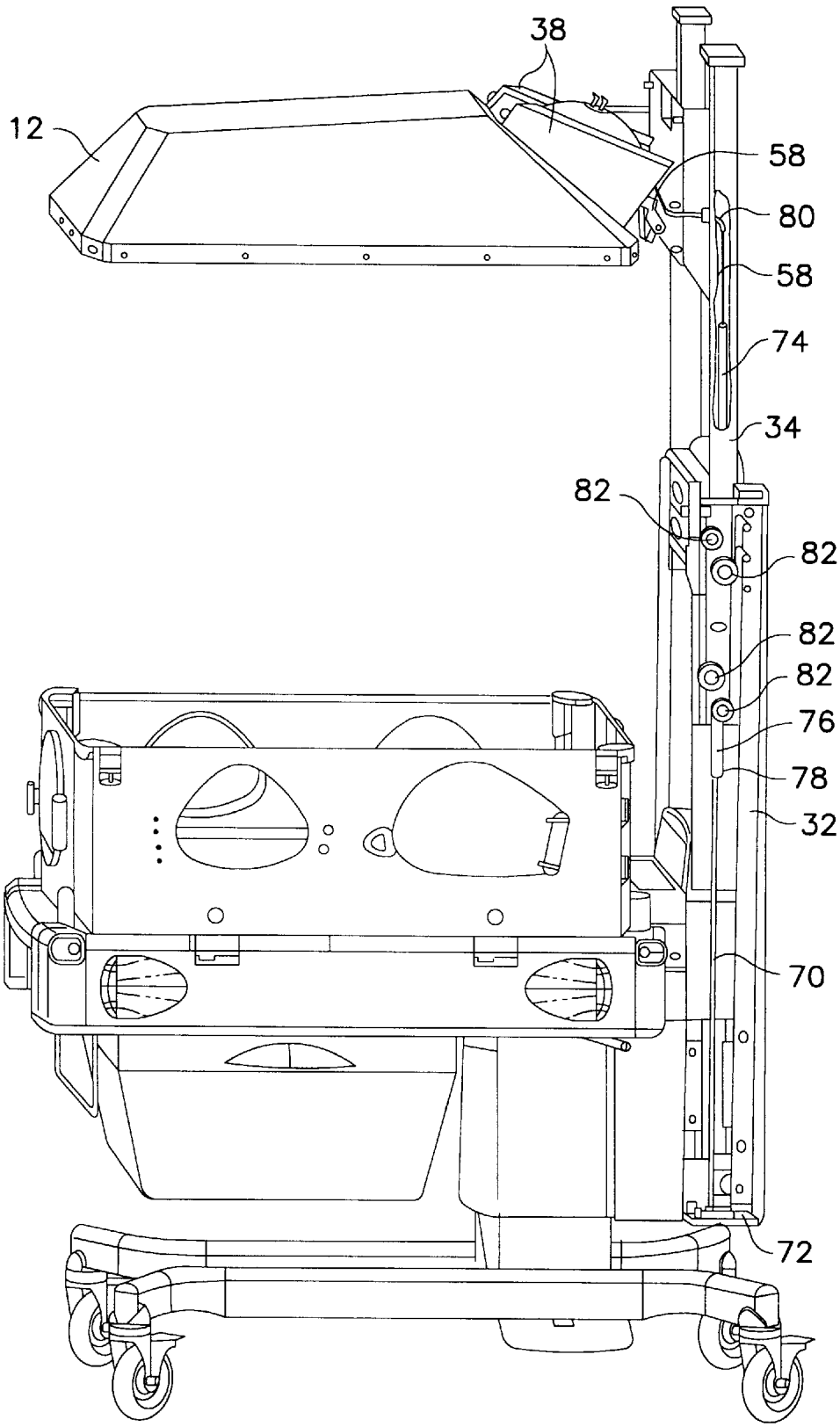
FIG. 5 is a side perspective view of the infant warming apparatus, partly in section, showing the heater in its upper position.

Turning now to FIG. 5, there is shown a side view, partly in cross section, to illustrate the operation of the mechanism to operate the doors 38 as the heater canopy 12 is moved between its extreme positions, that is, from the upper position to the lower position and vice versa. In this figure, there can be seen a heater door activation rod 70 that is fixed at its base to a bracket 72. Activation rod 70 is contained within one of the stationary frame member 32 and thus is internal of the unit itself. A heater door activation tube 74 is coaxially, slidingly positioned around the activation rod 70 such that the activation tube 74 can slide along the activation rod 70 about the external surface thereof. At the upper end of the activation rod 70 there is there is located a spring 76, fixed at its upper end to the top of the activation rod 70 and its lower end is suspended downwardly and is free standing.

Likewise, the bottom of the activation tube 74 is fitted with a cup 78 that is adapted to contact the lower end of the spring 76 in a manner that will be explained.

The cable 58 is affixed to the upper end of the activation tube and the cable thereafter passes through a cable slide 80 in the movable frame member 34 to be affixed to the periphery of the cable spool 54 (FIGS. 3B and 4B).

Accordingly, the operation of the door actuating mechanism can now be described. As the heater canopy 12 is moved from lower position as shown in FIG. 2 to the upper position as shown in FIG. 1, and returning to FIG. 5, the movable frame member 34 moves upwardly guided by a plurality of rollers 82. Since the actuation rod 70 is fixed at its lower end to the bracket 72, the activation rod 70 is stationary but the activation tube 74, being fixed to the movable frame member 34 moves upwardly. As the heater canopy 12 nears its upper position, the cup 78 at the bottom of the actuation tube 74 engages the lower end of the spring 76 and thus the further upward movement of the activation tube 74 is constrained.

At this point, therefore, the end of the cable affixed to the upper end of the actuation tube 74 is prevented from continuing upwardly and thus the cable 58 begins to rotate the cable spool 54 (see FIGS. 3B and 4B) since the cable 58 is fixed but the heater canopy 12 continues upwardly. As the heater canopy 12 thus continues its upward travel, fixed cable 58 rotates the cable spool 54 and, as explained, also rotates the pivotably mounted doors 38 so that they are rotated to the open position and the radiant heater 60 can be activated.

Accordingly, as previously outlined, by the use the actuation tube 74 that slides over the activation rod 70 for a predetermine distance, the cable 58 does not start to activate the doors 38 to move the doors 38 to their open position until the activation tube 74 has moved upwardly a predetermined distance. The advantage of such mechanism is that the doors 38 do not start to open immediately upon the initiation of the upward movement of the heater canopy 12 and thus the movement of the doors 38 is delayed until the heater canopy 12 is safely out of the reach of an infant positioned on the infant pedestal 14 or the attending personnel.

The same is true upon moving the heater canopy 12 from its upper position to its lower position. As the heater canopy 12 is initially moved downwardly, the doors 38 immediately rotate toward their closed position by the spring bias that causes the cable spool 54 to rotate toward that position. Thus, as the heater canopy 12 moves downwardly, the doors 38 are immediately moved to the closed position as the cable 58 is loosened and the cable spool 54 is able to rotate. As the heat canopy 12 moves further downwardly, eventually, it will reach the upper end of the activation tube 74 and cause it to move downwardly over the activation rod 70 to eventually reach a lower position where the lower end of the activation tube 74 rests against the bracket 72.

As can be seen, however, again the initial movement of the heater canopy 12 quickly closes the doors at the upper range of movement and by the time the activation tube 74 commences its movement downwardly, the doors 38 have already closed so that there is no danger of the heated surfaces within the heater canopy 12 reaching a position where those surfaces could be touched by an infant or by the attending personnel. In the preferred embodiment, the mechanism is dimensioned such that the doors 38 open and close within the upper 6–8 inches of travel with respect to the upper position of the heater canopy 12.

Figure 6A:
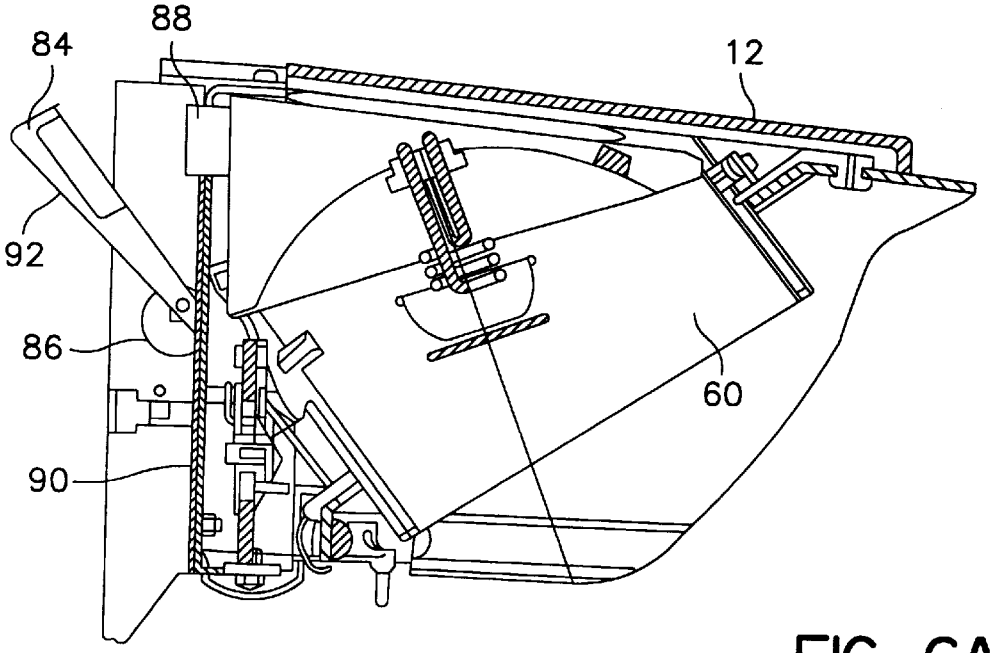
FIG. 6A and 6B are enlarged, side cross sectional views of the heater canopy constructed in accordance with the present invention.
Figure 6B:
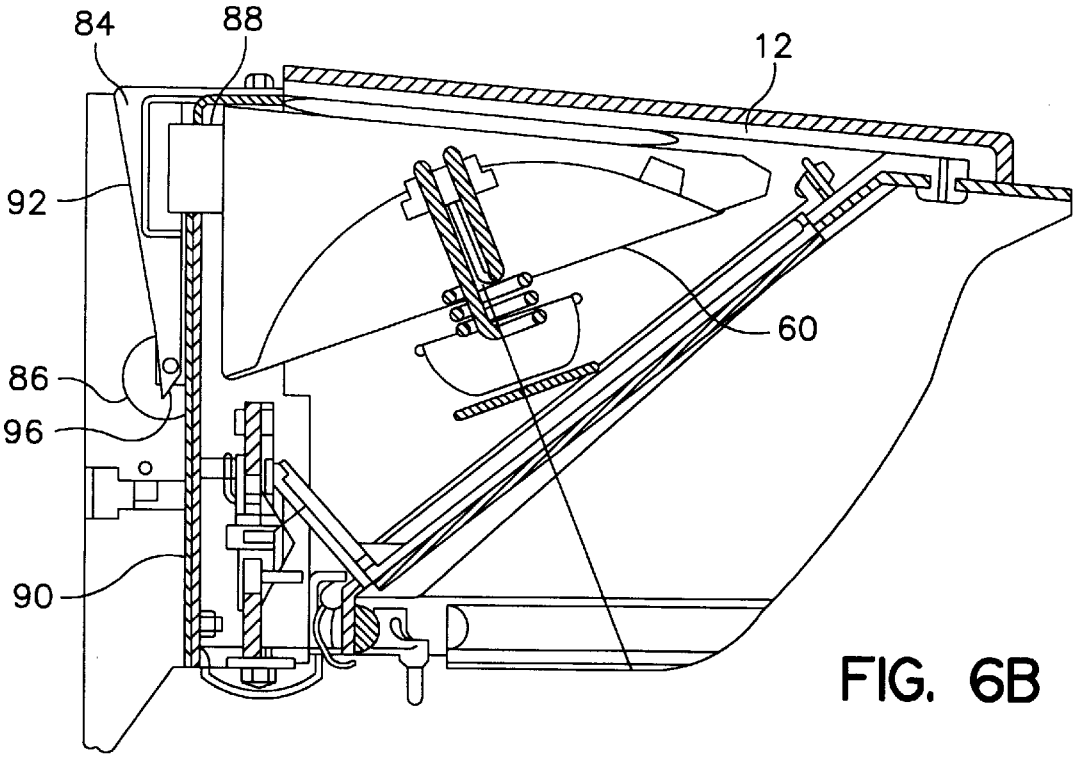

Turning now to FIGS. 6A and 6B, there are shown side cross-sectional views of the heater canopy 12 constructed in accordance with the present invention and illustrating a further feature of the subject invention. In this FIG. , there is vent flap 84 that is pivotally movable and which is in its open position in FIG. 6A indicative of the position of FIG. 1 where the heater canopy is in its upper position and in the closed position in FIG. 6B indicative of the heater canopy 12 in the lower position as shown in FIG. 2. As may be seen, the vent flap 84 is biased toward its open position by means of a vent spring 86, shown schematically, acting against the vent flap 84. Obviously, there are other means of providing a bias to the vent flap 84 that would bias that component toward the open position.

There is a vent opening 88 formed in the heater housing 90 and which, when open, provides a venting of the heated surfaces within the heater housing to prevent overheating of the radiant heater 60 and its associated structure. As shown in FIG. 6A position, the vent flap 84 is in it open position so that it is in that position when the radiant heater 60 is activated so that the natural convection will provide a cooling effect to the components within the heater housing. In the position of FIG. 6B, the vent flap 84 covers the vent opening 88 and therefore there is no such natural convective cooling. In the position of FIG. 6B, the heater canopy 12 is in its lower position and the radiant heater 60 is inactivated. In that position, there is a possibility of an attending person inadvertently touching any one or more of the components internal of the heater housing 90 and which component may still be heated.

Accordingly, with the use of the vent flap 84, the natural convective cooling can take place with the radiant heater 60 contained within the heater canopy 12 when in its upper position out of reach of the attending personnel but the vent flap 84 is closed when the heater canopy 12 is in its lower position to provide protection against the inadvertent touching by such personnel.

There is also a mechanism to insure that the vent flap 84 is automatically in the proper position when the heater canopy 12 is in its upper or its lower positions. The operation of that mechanism is based upon the stationary frame member 32 (FIG. 1) actually encountering the outside surface 92 of the vent flap 84 and forcing the vent flap 84 against the spring bias to the closed position. In practice, as, for example, the heater canopy 12 moves toward its lower position, the wedge shaped outside surface 92 of the vent flap 84 encounters an upper cap 94 (FIG. 1) that is atop one of the stationary frame members 32. Further lowering of the heater canopy 12 causes that upper cap 94 to force the vent flap 84 against the spring bias to its closed position as shown in FIG. 6B. As the heater canopy 12 continues its downward progress, the outside surface 92 continues to ride along an exterior of the stationary frame member 32 to maintain the vent flap 84 in its closed position.

In the reverse, as the heater canopy 12 is moved by the user from its lower position where it acts the function of an incubator to its upper position where it becomes an infant warmer, the outside surface 92 of the vent flap 84 rides along the exterior surface of one of the stationary frame members 32 until it reaches the upper cap 94 where it disengages from the stationary frame member 32 and the bias of vent spring 86 causes the vent flap 84 to open. At this point the heater canopy 12 is at a height where it is safe from intrusion by the user. The vent flap 84 thus opens automatically to a maximum opening and is stopped for further opening by the abutting of the flat surface 96 on the pivotal end of the vent flap 84 with the outside flat surface of the heater housing 90.

As can therefore be seen, both the vent flap 84 and the doors 38 are biased toward the safer position, that is, the doors 38 are biased toward their closed position where the infant is safe and the vent flap 84 is biased toward its open position to vent the heater in the event of a failure of any one or more of the various mechanisms.

Figure 7:
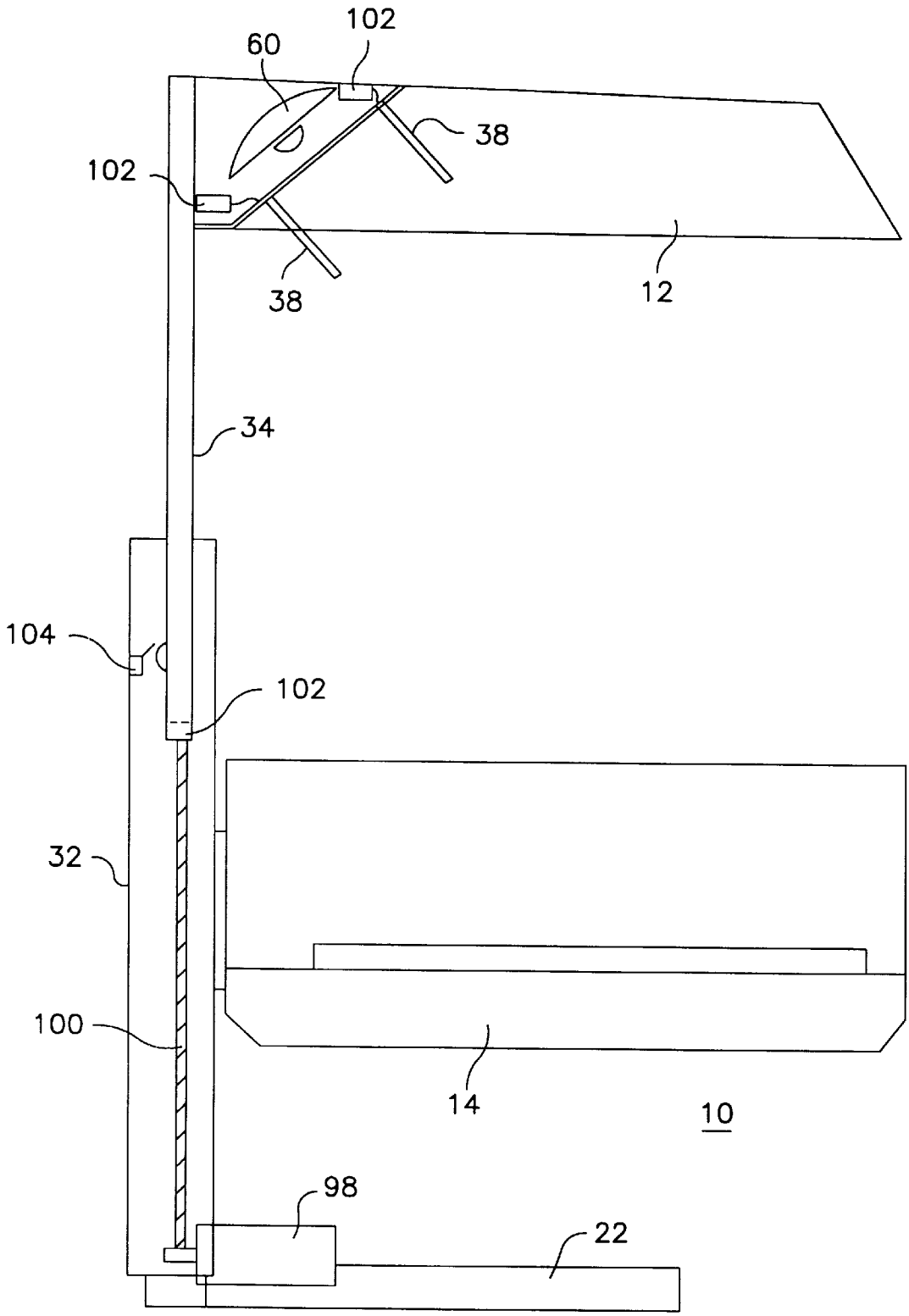
FIG. 7 is a schematic view of a mechanism to raise and lower the radiant heater that can be used with the present invention.

Turning, finally, to FIG. 7, there is shown a schematic view of the present invention and illustrating a powered system for raising and lowering the heater canopy 12. In this Fig, an electric motor 98 is shown schematically and is used to power a threaded screw 100 that extends upwardly within the interior of the stationary frame member 32 and engages with a threaded lug 102 that is affixed to one of the movable frame members 34. As a practice, it will be apparent that since there are preferably two stationary frame members 32 and two movable frame members 34, the one set of movable and stationary members can be used to house the door operating mechanism that is the subject of the present invention and the other set of stationary and movable frame members can be used to house the mechanism utilized to raise and lower the heater canopy 12.

In any event, the electric motor 98 is coupled to the lower end of the threaded screw 100 by means of a gear train or other coupling and therefore the rotation of the electric motor 98 will cause the movable frame members 34 to raise and lower and thus raise and lower the heater canopy 12. As can be seen, the are obviously many different ways of providing a mechanism to raise and lower the heater canopy 12, the present illustration being only one of the possible constructions.

As a still further embodiment, the doors 38 can be moved between the open and the closed position by means of a pair of servomotors 102, shown schematically, that can act to rotate the doors 38 or door, in the case of a single door. As such, there may be one or more servomotors 102, depending on the number of doors, and each servomotor 102 can be automatically activated. In the case of opening the doors 38, there can be a limit switch 104 that is activated by the heater canopy 12 when it reaches it upper position that is tripped to activate the servomotor to open the doors at that upper position. The closing of the door or doors can be effected through the use of a conventional switch (not shown) that is activated when the user energizes the electric motor 98 to move the heater canopy 12 from the upper position to the lower position. A delay can allow the doors 38 to close before the electric motor 98 commences the downward movement of the heater canopy 12. As such, therefore, a means can be provided to open and close the doors 38 when the heater canopy 12 is actually in the upper position.

As can be seen, other controls may be used to activate the servomotor to carryout the opening and closing of the doors while in the upper position.

Those skilled in the art will readily recognize numerous adaptations and modifications which can be made to the infant care apparatus of the present invention which will result in an improved control system, yet all of which will fall within the scope and spirit of the present invention as defined in the following claims. Accordingly, the invention is to be limited only by the following claims and their equivalents.

We claim:

1. An infant care apparatus, said apparatus having a surface on which an infant is positioned, a vertical member extending upwardly from said surface, a housing containing a heater mounted to said vertical member and being movable along said vertical member between a lower position near said surface and an upper position, said heater having at least one door movable between an open position wherein said heater is exposed and closed position wherein said heater is protectively confined within said housing, door actuator means adapted to open said at least one door as said heater moves from said lower position to said upper position and to close said at least one door as said heater moves from said upper position to said lower position.

2. An infant care apparatus as defined in claim 1 wherein said at least one door comprises two doors.

3. An infant care apparatus as defined in claim 1 wherein said surface is generally rectangular and said vertical member is located along one side of said rectangular surface wherein said heater is generally vertically positioned above said one side when in said upper position.

4. An infant care apparatus as defined in claim 1 wherein said vertical member comprises at least one vertical stationary frame member and a movable frame member movably interfitted into said at least one stationary frame member, said heater being affixed to said movable frame member.

5. An infant care apparatus as defined in claim 1 wherein said at least one vertical stationary member comprises two stationary members.

6. An infant care apparatus, said apparatus comprising a base, a planar infant bed supported by said base for underlying an infant, a vertical member extending upwardly from said base, a heater canopy mounted to said vertical member and containing a radiant heater, said heater canopy being movable between a lower position near said planar infant bed and an upper position where said radiant heater can provide infrared energy to impinge upon an infant resting on said planar infant bed, said heater canopy having at least one door movable between an open position wherein said radiant heater is exposed and closed position wherein said radiant heater is protectively confined within said heater canopy, door actuator means adapted open and close said at least one door when said radiant heater is at or near said upper position.

7. An infant care apparatus as defined in claim 6 wherein said infant bed further comprises a plurality of sides forming upwardly extending edges surrounding the periphery of said infant bed to confine an infant within said infant bed.

8. An infant care apparatus as defined in claim 7 wherein said heater canopy has a peripheral edge in the same configuration as said upwardly extending edges of said sides and said peripheral edge fits against said upwardly extending edges to form an enclosed infant compartment when said heater canopy is in said lower position.

9. An infant care apparatus as defined in claim 8 wherein said infant bed has at least one generally straight side and said vertical member is positioned along said straight side.

10. An infant care apparatus as defined in claim 8 wherein said vertical member comprises a stationary frame member and a movable frame member, and wherein said heater canopy is affixed to said movable frame member, said movable frame member being vertically movable with respect to said stationary frame member to allow said heater canopy to move between said upper and said lower positions.

11. An infant care apparatus as defined in claim 6 wherein said at least one door comprises two doors.

12. An infant care apparatus as defined in claim 11 where said door actuator comprises a circular cable spool rotatably affixed to said heater canopy and a linkage means interconnecting between said cable spool and each of said two doors whereby the rotation of said cable spool cause said doors to move between said open and said closed position.

13. An infant care apparatus as defined in claim 12 wherein said doors are biased toward said closed position.

14. An infant care apparatus as defined in claim 12 wherein said door actuator further comprises a cable having one end affixed to the outer periphery of said circular cable spool and wrapped partially therearound and having the other end affixed to a movable point having a predetermined upper limit of movement in the vertical direction, said other end of said cable adapted to move upwardly with said movable point to said predetermined upper limit of movement and said other end of said cable becomes fixed such that the further upward movement of said heater canopy causes said cable to rotate said cable spool to move said doors to said open position.

15. An infant care apparatus, said apparatus having a surface on which an infant is positioned, a vertical member extends upwardly from said surface, a housing mounted to said vertical member and movable along said vertical member between a lower position near said surface and an upper position, said heater having at least one door movable between an open position wherein said heater is exposed and a closed position wherein said heater is confined within said housing and a door actuator means adapted open and close said at least one door when said heater is at or near said upper position.

16. An infant care apparatus as defined in claim 15 wherein said door actuator opens and closes said at least one door when said heater is within a predetermined distance from said upper position.

17. An infant care apparatus as defined in claim 15 wherein said door actuator opens and closes said at least one door when said heater is no more than 12 inches from said upper position.

18. An infant care apparatus as defined in claim 15 wherein said door actuator is a servomotor.

19. An infant warming apparatus, said apparatus comprising a flat, planar surface adapted to underlie an infant, a vertical structure extending upwardly from said flat, planar surface, a heater canopy mounted to said vertical structure so as to be movable between upper and lower positions, said heater canopy containing a radiant heater and having at least one door having a closed position adapted to enclose said heater and an open position to allow said radiant heater to emit energy exterior of said canopy, said at least one door being spring biased toward said closed position, a cable spool rotatably affixed to said heater canopy, linkage means interconnecting said at least one door with said cable spool whereby rotation of said cable spool causes said at least one door to move between said closed and said open positions, a cable having one end attached to and partially wound around said cable spool and having other end affixed to a movable member, means to cause said movable member to move a predetermined distance along with said heater canopy, said predetermined distance being less than the total distance moved by said heater canopy in moving between said upper and lower positions, whereby said cable causes said at least one door to open by rotating said cable spool only after said movable member reaches said predetermined distance in the upward direction to cause said at least one door to open only when said heater canopy has reached a predetermined point in said canopy moving from said lower position to said upper position.

20. An infant warming apparatus as defined in claim 19 wherein said at least one door comprises two doors.

21. An infant warming apparatus as defined in claim 20 wherein said apparatus further comprises a fixed rod of predetermined height in a fixed position and wherein said movable member is movable affixed to said rod.

22. An infant warming apparatus as defined in claim 21 wherein said rod includes a stop to prevent movement of said movable member in the upward direction beyond said stop means.

23. An infant care apparatus, said apparatus having a surface on which an infant is positioned, a vertical member extending upwardly from said surface, a heater mounted to said vertical member and being movable along said vertical member between a lower position near said surface and an upper position, said heater having at least one door movable between an open position wherein said heater is exposed and closed position wherein said heater is protectively confined within said housing, a servomotor adapted to open said at least one door, said servomotor being activated when said heater is in said upper position to open and to close said at least one door.

24. An infant care apparatus as defined in claim 23 wherein said servomotor is activated by a switch that senses when said heater is in said upper position.

25. An infant care apparatus, said apparatus having a surface on which an infant is positioned, a vertical member extending upwardly from said surface, a housing containing a heater mounted to said vertical member and being movable along said vertical member between a lower position near said surface and an upper position, said housing having at least one vent adapted to ventilate the housing, a vent flap operatively associated with said at least one vent, said vent flap being movable between an open position wherein said housing is vented to the atmosphere and a closed position covering said at least one vent, vent flap actuator means adapted to open said vent flap as said heater moves from said lower position to said upper position and to close said vent flap as said heater moves from said upper position to said lower position.

26. An infant care apparatus as defined in claim 25 wherein said vent flap is biased towards said open position.

* * * * *